United States Patent [19]

Bronner

[11] 4,324,749

[45] Apr. 13, 1982

[54] THREE-DIMENSIONAL EXCHANGE ELEMENT FOR LIQUID GUIDANCE IN LIQUID-GAS CONTACT SYSTEMS

[75] Inventor: Jürgen Bronner, Wuppertal, Fed. Rep. of Germany

[73] Assignee: Akzona Incorporated, Asheville, N.C.

[21] Appl. No.: 160,671

[22] Filed: Jun. 18, 1980

Related U.S. Application Data

[63] Continuation of Ser. No. 915,412, Jun. 14, 1978, abandoned.

[30] Foreign Application Priority Data

Jun. 14, 1980 [DE] Fed. Rep. of Germany ..... 2726723

[51] Int. Cl.[3] ..... F28C 1/02

[52] U.S. Cl. ..... 261/112; 261/98; 261/DIG. 72; 261/DIG. 11

[58] Field of Search ..... 261/94–98, 261/100–103, 110, 112, DIG. 11, DIG. 72; 55/524, 527, 528, 486, 487, 489; 428/171, 172, 212–214

[56] References Cited

U.S. PATENT DOCUMENTS

| | | | |
|---|---|---|---|
| 246,781 | 9/1881 | Jennings | 261/103 |
| 2,054,809 | 9/1936 | Fleisher | 261/DIG. 11 |
| 2,198,305 | 4/1940 | Crawford | 261/103 |
| 2,552,910 | 5/1951 | Steinman | 261/DIG. 72 |
| 2,629,459 | 2/1953 | Hammond et al. | 55/527 |
| 2,692,654 | 10/1954 | Pryor | 55/524 |
| 2,856,323 | 10/1958 | Gordon | 428/171 |
| 2,863,808 | 12/1958 | Markels, Jr. | 261/106 |
| 2,888,095 | 5/1959 | Perrini et al. | 55/487 |
| 3,083,952 | 4/1963 | Goodloe et al. | 261/99 |
| 3,218,048 | 11/1965 | Smith, Jr. et al. | 261/94 |
| 3,295,840 | 1/1967 | Donald | 261/95 |
| 3,304,069 | 2/1967 | Palmer, Sr. | 261/DIG. 11 |
| 3,352,423 | 11/1967 | Osterman | 55/527 |
| 3,354,022 | 11/1967 | Dettre et al. | 428/171 |
| 3,412,737 | 11/1968 | Pinter | 55/524 |
| 3,616,157 | 10/1971 | Smith | 428/171 |
| 3,616,159 | 10/1971 | Kamp | 161/169 |
| 3,717,532 | 2/1973 | Kamp | 156/199 |
| 3,748,828 | 7/1973 | Lefebvre | 261/103 |
| 4,007,745 | 2/1977 | Randall et al. | 55/524 |
| 4,022,596 | 5/1977 | Pedersen | 55/528 |

FOREIGN PATENT DOCUMENTS

| | | | |
|---|---|---|---|
| 312643 | 5/1973 | Austria . | |
| 629103 | 10/1961 | Canada | 428/171 |
| 666465 | 9/1938 | Fed. Rep. of Germany . | |
| 690633 | 8/1939 | Fed. Rep. of Germany . | |
| 1551420 | 1/1967 | Fed. Rep. of Germany . | |
| 2238957 | 8/1972 | Fed. Rep. of Germany . | |
| 2702043 | 1/1977 | Fed. Rep. of Germany . | |
| 1230416 | 8/1970 | United Kingdom . | |
| 1497130 | 1/1978 | United Kingdom . | |

*Primary Examiner*—Gregory N. Clements
*Attorney, Agent, or Firm*—Francis W. Young; Jack H. Hall

[57] ABSTRACT

Three-dimensional exchange element for heat exchange units for gas/liquid systems which consists of filaments with a diameter of 0.1 to 2.5 mm, such filaments, which are welded together at their interlacing points, being arranged in a level plane showing equidistantly spaced hump-like projections.

2 Claims, 3 Drawing Figures

Figure 2:
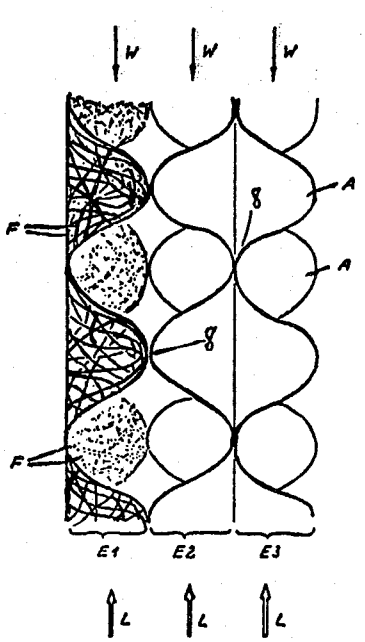

THREE-DIMENSIONAL EXCHANGE ELEMENT FOR LIQUID GUIDANCE IN LIQUID-GAS CONTACT SYSTEMS

This is a Continuation of application Ser. No. 915,412 filed June 14, 1978, now abandoned.

The invention relates to a three-dimensional exchange element for liquid guidance in liquid-gas contact systems consisting of synthetic filaments of a diameter of about 0.1 to 2.5 mm.

Exchange elements of this type, as used in material and/or heat exchanging systems, are described in e.g. German Patent disclosure No. 2,158,171. They consist of more or less loosely constructed fabrics of synthetic monofilaments, whereby the structure of the fabric permits only a slight extension in the third dimension. Exchange elements of this type, which are used essentially in vertical alignment for vertical flow possess only a minimum gas permeability and cause only a moderate breakdown of the trickling liquids into drops and thin films. The thermal efficiency of such elements is correspondingly low. Moreover, these exchange elements have the drawback of relatively high production costs, on the one hand to weave the heavy monofilaments to fabrics, and on the other hand, to transform these monofilament fabrics into self-supporting structural elements of sufficient rigidity.

As described in German Patent Disclosure No. 24 34 082, three-dimensional exchange elements of greater rigidity can be made from the fabrics described above in combination with multifilaments, by folding the fabric in a zigzag pattern followed by setting. These corrugated exchange elements can be stacked crossways thus resulting in exchanger packs which are suitable practically only for cross-current operation.

The object of the present invention is to avoid the drawbacks of said known exchange elements. In particular, it aims at providing a simple exchange element, economical to produce, having a high thermal efficiency and which when used in cooling towers and cooling stacks has a substantially greater cooling efficiency per unit volume. It is a further object to provide an exchange element that is more versatile in that it can be used in an upright or horizontal position, or suspended, and can be operated in a counter current or cross current situation.

These objects are met by the above-described three-dimensional exchange element according to the invention in that the randomly intersecting filaments, fused at their points of intersection, form essentially a planar sheet or web which exhibits, at regular intervals, hump-like depressions of essentially like depth or, conversely, hump-like projections having essentially equal height.

The exchange elements of the invention can be obtained, e.g. by a method described in U.S. Application Ser. No. 703,277, filed July 7, 1976, which disclosure is incorporated by reference herein. In said application, the melt of a synthetic polymer is spun from a spinneret with multiple spinning orifices in an essentially perpendicular direction onto a moving surface located at a distance from the spinneret, which surface exhibits a hump profile of about 20 to 70 mm height. The equidistantly aligned humps of essentially identical height may assume the shape of a pyramid, cone or hemisphere. Preferably, they assume the shape of a truncated cone or truncated pyramid. The filaments emerging from the spinning orifices are deposited in a thin layer in an intersecting arrangement on and between the humps and become mutually fused on cooling. The sheet structure which is subsequently taken off the moving surface is three-dimensional, i.e. while extending essentially in one plane, it presents at regular intervals hump-like depressions of essentially like depth forming the well-defined third dimension.

The exchange elements of the invention have, consequently, a profiled trickling surface. This means an increase in exchange area per unit volume and facilitates the continuous formation of new liquid faces. Moreover, the exchange elements of the invention have a perforated trickling surface. This facilitates the continuous renewal and disintegration of liquid films by trickling liquid and gas flow. Hence, the films being formed are quickly disrupted so that "concentration" of the liquid (i.e. a levelling of the temperature in the liquid film) can be avoided.

The three-dimensional exchange elements of the invention are readily made into self-supporting exchanger packs, by cementing or fusing together alternately the bottoms and tops (i.e. the mating opposite surfaces of the planar web) or adjacent elements cut to the proper dimensions.

To facilitate contact between the hump-like projections of adjacent elements, said hump-like projections assume preferably the shape of a truncated cone or truncated pyramid.

Aside from substantially lower production and manufacturing costs, the exchange elements of the invention present other important advantages. For instance, for an identical gas throughput a smaller volume will yield the same thermal efficiency or because of the greater cooling capacity a greater thermal efficiency, a feature which is not insignificant with cooling towers. Moreover, because of their special construction, the exchange elements of the invention have a much lower structural weight compared with conventional inserts. The exchange elements of the invention have a weight of only 5 to 10 kg/m$^3$, whereas perforated PVC sheets (monofilament fabrics) weigh from 20 to 30 kg/m$^3$. This is especially important for static reasons in large contact installations. Furthermore, the exchange elements of the invention have relatively large openings insuring a good self-cleaing action, which is especially advantageous in cooling towers or cooling stacks. Lastly, they have a high rigidity and a very large contact surface assisting film formation. The efficiency of the exchange elements is, finally, unaffected by the direction of insertion, i.e. the elements can be inserted in vertical, horizontal or slanted alignment, or by the direction of the gas and liquid currents, i.e. a cross current, monodirectional current or counter current may be used equally well.

The hump-like projections should have a height of about 20 to 70 mm. While smaller dimensions are possible, they make bonding of the elements to form exchanger packs, e.g. by hot air fusing, more difficult and under certain conditions fail to yield the desired permability between surfaces. On the other hand, greater dimensions may impair the rigidity of the material.

The exchange elements of the invention can be produced from any conventional, filament-forming synthetic polymer. Use is preferably made of polyamide 6, polyamide 66, polyethylene terephthalate or polypropylene, whereby polyamide 6 is preferable because of its chemical stability.

The subject matter of the invention is, in particular, the use of the three-dimensional exchange elements of the invention as trickle elements, both in cooling towers and cooling stacks, especially in brushwood cooling stacks such as are used in spas. In said application, they can be substituted for the expensive, high-maintenance brushwood bundles.

Other end uses for the exchange element of the invention are, e.g. packing elements in exchanger columns, as packing material in gas scrubbers and as mist eliminator in condensors.

Figure 1:
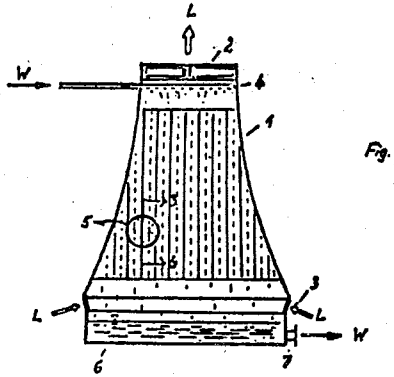
Figure 3:
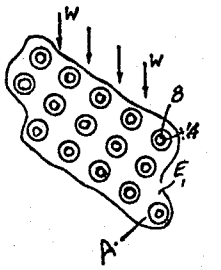

The invention is further illustrated by the drawing wherein:

FIG. 1 is a schematic of a cooling tower equipped with the exchange elements of the invention, FIG. 2 is a scale drawing of an exchanger packing composed of several elements, and FIG. 3 is a schematic view of a section of an exchange element taken along the plane 3—3 of FIG. 1.

FIG. 1 illustrates the essential parts of a cooling tower. The top of tower 1 is equipped with a fan 2 which aspirates air L via ports 3 at the bottom of the tower. The air flows through the tower in counter current to water W supplied via distributor units 4, which water trickles down through the exchange elements, shown graphically in the broken-away section 5. The cooled water is collected in reservoir 6 and discharged via drain pipe 7 e.g. into a stream.

FIG. 2 illustrates an exchange packing composed of multiple elements E1, E2, E3, etc. Each element E is composed of a plurality of mutually intersecting filaments F, fused at their points of intersection, which filaments are aligned in a plane whose essentially level extension exhibits at regular intervals hump-like projections A of essentially equal height. In this instance, the projections are hemispherical and comprise a contact surface 8 for a like projection on the adjacent element which in this instance is punctiform. It is therefore advantageous to select truncated pyramids or truncated cones instead of hemispherical shapes since a larger contact area between adjacent elements E1, E2, E3, etc., is desirable. FIG. 2 also shows the relatively wide passages between the filaments F. Therefore, instead of the illustrated counter current of water W and air L, a cross current can be used just as well.

FIG. 3 shows an efficient alignment of the hump-like projections A in element E, which are in the form of truncated cones. In this modification, the contact surface 8 is substantially larger than that possible with the hemispherical construction of FIG. 2, providing a larger area for cementing for fusing elements together. They should as much as possible be aligned in such a manner that the water W trickles down from one projection onto a projection below. This insures a substantially greater efficiency.

The explanations for the cooling tower apply as well to the use of the exchange elements of the invention in cooling stacks. Instead of water, a salt brine is supplied to the exchanger pack and trickles through the packing in a cross current with respect to air.

What is claimed is:

1. In a liquid-gas contact system wherein said liquid-gas comprises a vertical tower which contains a heat exchange unit through which water flows countercurrently or cross-currently to a stream of gas flowing therethrough, the improvement of said a heat exchange unit comprising a plurality of 3-dimensional, mutually supporting exchange elements arranged side-by-side, in contact with each adjacent element and each of said elements comprising randomly intersecting synthetic filaments having a diameter of about 0.1 to 2.5 mm, fused at their points of intersection, wherein said filaments form a self-supporting planar web with a density of from 5 to 10 kg per cubic meter and having hump-like projections of a substantially identical height of from about 20 to about 70 mm at regular intervals on the face of said planar web, said projections comprising contact surfaces for adjacent elements of like construction, wherein said elements are positioned parallel to each other and in contact with an adjacent element at said projections.

2. The 3-dimensional exchange element of claim 1, wherein the hump-like projections are truncated.

* * * * *